US006430975B1

(12) United States Patent
McDaid

(10) Patent No.: US 6,430,975 B1
(45) Date of Patent: Aug. 13, 2002

(54) TIE LOCK ASSEMBLAGE WITH REPLACEABLE LOCK MECHANISM

(75) Inventor: Cornelius McDaid, Dorchester, MA (US)

(73) Assignee: Kryptonite Corporation, Canton, MA (US)

( * ) Notice: Subject to any disclaimer, the term of this patent is extended or adjusted under 35 U.S.C. 154(b) by 0 days.

(21) Appl. No.: 10/040,777

(22) Filed: Dec. 29, 2001

Related U.S. Application Data

(63) Continuation of application No. 09/390,549, filed on Sep. 3, 1999, now Pat. No. 6,341,509.

(51) Int. Cl.[7] ..... E05B 67/24

(52) U.S. Cl. ..... 70/39; 70/38 A; 70/52; 70/53; 70/55; 70/371; 70/DIG. 56

(58) Field of Search ..... 70/39, 49, 38 A, 70/52, 53, 371, 233, 417, 18, 38 R, 38 B, 38 C, 54–56, 372, 423, 455, 424, 427, 428, DIG. 43, DIG. 56

(56) References Cited

U.S. PATENT DOCUMENTS

| | | | | | |
|---|---|---|---|---|---|
| 2,433,114 | A | * | 12/1947 | Gray | 70/38 A |
| 2,457,650 | A | * | 12/1948 | Dyson | 70/38 A |
| 2,959,951 | A | * | 11/1960 | Mirkin | 70/53 |
| 3,855,824 | A | * | 12/1974 | Falk | 70/38 A |
| 4,545,224 | A | * | 10/1985 | Zane | 70/39 |
| 4,584,855 | A | * | 4/1986 | Burlingame | 70/38 A |
| 4,819,464 | A | * | 4/1989 | Kuo | 70/49 X |
| 4,831,849 | A | * | 5/1989 | Kortenbrede | 70/49 |
| 4,918,950 | A | * | 4/1990 | Foshee | 70/38 A |
| 4,949,564 | A | * | 8/1990 | Burzilai | 70/417 |
| 5,010,746 | A | * | 4/1991 | Zane et al. | 70/55 X |
| 5,092,142 | A | * | 3/1992 | Zane et al. | 70/39 |
| 5,189,893 | A | * | 3/1993 | Kortenbrede | 70/38 A |
| 5,406,812 | A | * | 4/1995 | Jaw | 70/38 A |
| 5,417,092 | A | * | 5/1995 | Iu | 70/39 X |
| 5,488,845 | A | * | 2/1996 | Hsieh | 70/38 A |
| 5,987,940 | A | * | 11/1999 | Chang | 70/39 X |
| 6,341,507 | B1 | * | 1/2002 | McDaid | 70/39 |

FOREIGN PATENT DOCUMENTS

| | | | |
|---|---|---|---|
| DE | 2970087 | * | 9/1997 |
| GB | 2240578 | * | 8/1991 |
| GB | 2243866 | * | 11/1991 |
| WO | WO93/23646 | * | 11/1993 |

* cited by examiner

*Primary Examiner*—Lloyd A. Gall
(74) *Attorney, Agent, or Firm*—Morse, Altman & Martin

(57) ABSTRACT

Changing the locking mechanism in a U-lock, cable lock or other tie lock as often as desired is achieved without compromising the lock's resistance to physical damage. This function is achieved by an auxiliary sleeve that removably fits over the U-lock's crossbar or the cable lock's end bar. Either bar provides an aperture, which is too small to permit the locking mechanism to be picked or pried, but which is operatively positioned and sufficiently large to provide access for a key to the keyway of the locking mechanism.

2 Claims, 6 Drawing Sheets

TIE LOCK ASSEMBLAGE WITH REPLACEABLE LOCK MECHANISM

This application is a continuation of Ser. No. 09/390,549 filed on Sep. 3, 1999, now U.S. Pat. No. 6,341,509.

BACKGROUND OF THE INVENTION

1. Field of the Invention

The present invention relates generally to locks and, more particularly, to improved lock assemblages for preventing theft of bicycles, motorcycles, scooters, mopeds, and the like.

2. The Prior Art

A rapidly growing number of bicycles, motorcycles, scooters, mopeds, and the like are in use throughout the world. In many countries, from Europe to Asia, small powered and non-powered two wheeled vehicles; have become a necessity for meeting a wide variety of transportation, as well as recreation, requirements.

The security device of choice for protecting such vehicles against the omnipresent threat of theft has been a tie lock assemblage, for example, a U-lock or cable lock. Such a U-lock typically comprises a semi-enclosure member or shackle having legs or fittings with configured feet, a straight crossbar having openings for reception of these feet, and a locking mechanism in the crossbar for retaining or releasing these feet. Such a cable-lock typically comprises a cable having at one end of the cable a leg or fitting with a configured foot, a bar extending from the other end of the cable and having an opening for reception of this foot, and a locking mechanism in the bar for retaining or releasing this foot. For protection against theft, this tie lock assemblage ties a strut or the like of the vehicle to a post, rail or other station. Kryptonite Corporation of the United States of America pioneered the first effective lock assemblage for this purpose under the trademark KRYPTONITE.

Various methods have been adopted to challenge the security of such lock assemblages. These methods include cutting the shackle or cable with a heavy-duty bolt cutter, cutting the crossbar with a power saw, or disabling the locking mechanism with a power drill. In order to defeat such challenges, lock assemblage components are constructed from ever stronger materials in ever sturdier configurations.

As a practical matter, changing locking mechanisms from time-to-time to guard against loss or theft of keys is as important as reliance on physical strength of the lock assemblage. However, strong materials and sturdy configurations often tend to discourage simple and frequent replacement of locking mechanisms.

SUMMARY OF THE INVENTION

The primary object of the present invention is to facilitate the replacement of locking mechanisms in a lock assemblage as often as desired, without compromising its resistance to physical damage. In essence, this object is achieved by a tamper resistant sleeve, which fits over the crossbar and provides an aperture that is too small to permit the locking mechanism to be picked or pried, but that is operatively positioned and large enough to provide access for a key to the keyway of the locking mechanism.

More specifically, the object of the present invention is to provide a lock assemblage comprising a part having at least one leg or fitting provided with a configured foot, a bar or the like having an opening for receiving this foot, at least a spring pressed deadbolt within the bar for mating with the configured foot, a lock located in a seat within the bar for controlling the deadbolt, and a sleeve about the bar with an aperture that is sufficiently small to enable retention of the lock body within the seat and sufficiently large to permit access by a key to the keyway of the lock. In a U-lock version, the tie part is a shackle having two feet and a crossbar having two openings for receiving these feet. In a cable version, the tie is a cable having a foot at the end of the cable and an end bar having an opening for receiving this foot. The arrangement in each case is such that, when the foot or feet and the sleeve are disengaged from the bar, the lock body within the seat may be replaced readily.

Other objects of the present invention will in part be obvious and will in part appear hereinafter.

BRIEF DESCRIPTION OF THE DRAWINGS

For a fuller understanding of the nature and objects of the present invention, reference is made to the following specification, which is to be take in connection with the accompanying drawings wherein:

FIG. 9(*b*) is a top view of the lock as shown in FIG. 9(*a*);

FIG. 10(*b*) is a top view of the lock as shown in 10(*a*);

DETAILED DESCRIPTION OF THE PREFERRED EMBODIMENTS

Figure 1:
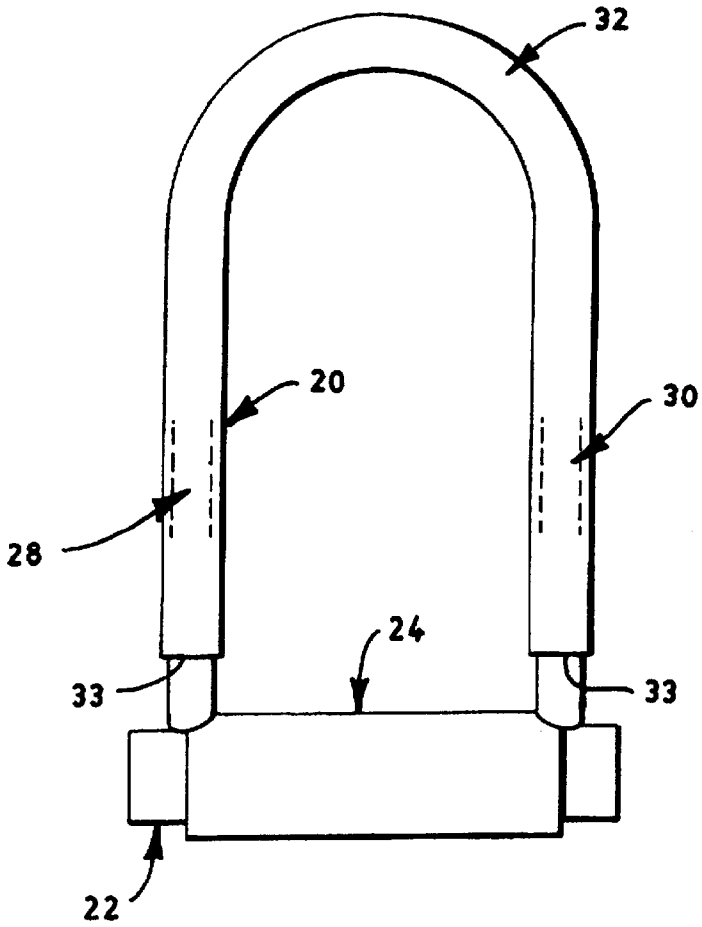
FIG. 1 is a front elevation of a U-lock assemblage comprising a shackle, a crossbar and a sleeve, embodying the present invention.
Figure 2:
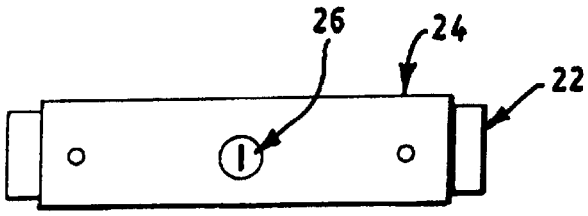
FIG. 2 is a bottom plan view of the U-lock assemblage as shown in FIG. 1.
Figure 3:
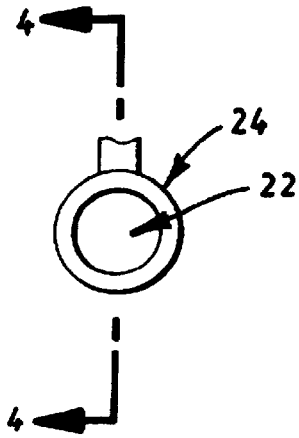
FIG. 3 is an end view of the crossbar of the U-lock assemblage as shown in FIG. 2.

The U-lock of FIGS. 1 to 11

An illustrated embodiment of the present invention is shown in FIGS. 1–4 as comprising a shackle 20, a crossbar 22, a sleeve 24 and a locking assembly 26 within the crossbar.

As shown, shackle 20 includes a pair of generally parallel legs 28, 30, which are joined by an arc 32. With the exception of the free extremities of the legs, shackle 20 has a uniform primary diameter. A plastic sleeve 33 is slipped over legs 28 and 30. The extremities of legs 28 and 30 have tapered portions 32 and 34, which extend to axial projection portions 36 and 38 that have reduced diameters. In proximity with these extremities are inwardly directed notches 40 and 42.

As shown, crossbar 22 is a hollow tube having spaced retainer holes 44 and 46 of relatively large diameter, and spaced pilot holes 48 and 50 of relatively small diameter. Retainer hole 44 and pilot hole 48 are aligned along a radial axis that is normal to the axis of the crossbar. Retainer hole 46 and pilot hole 50 are aligned along a radial axis that is normal to the axis of the crossbar. These two radial axes are parallel. The arrangement is such that pilot hole 48 and pilot hole 50, respectively, are adapted to receive projections 36 and 38 when legs 28 and 30 have been inserted through retainer holes 44 and 46.

Figure 4:
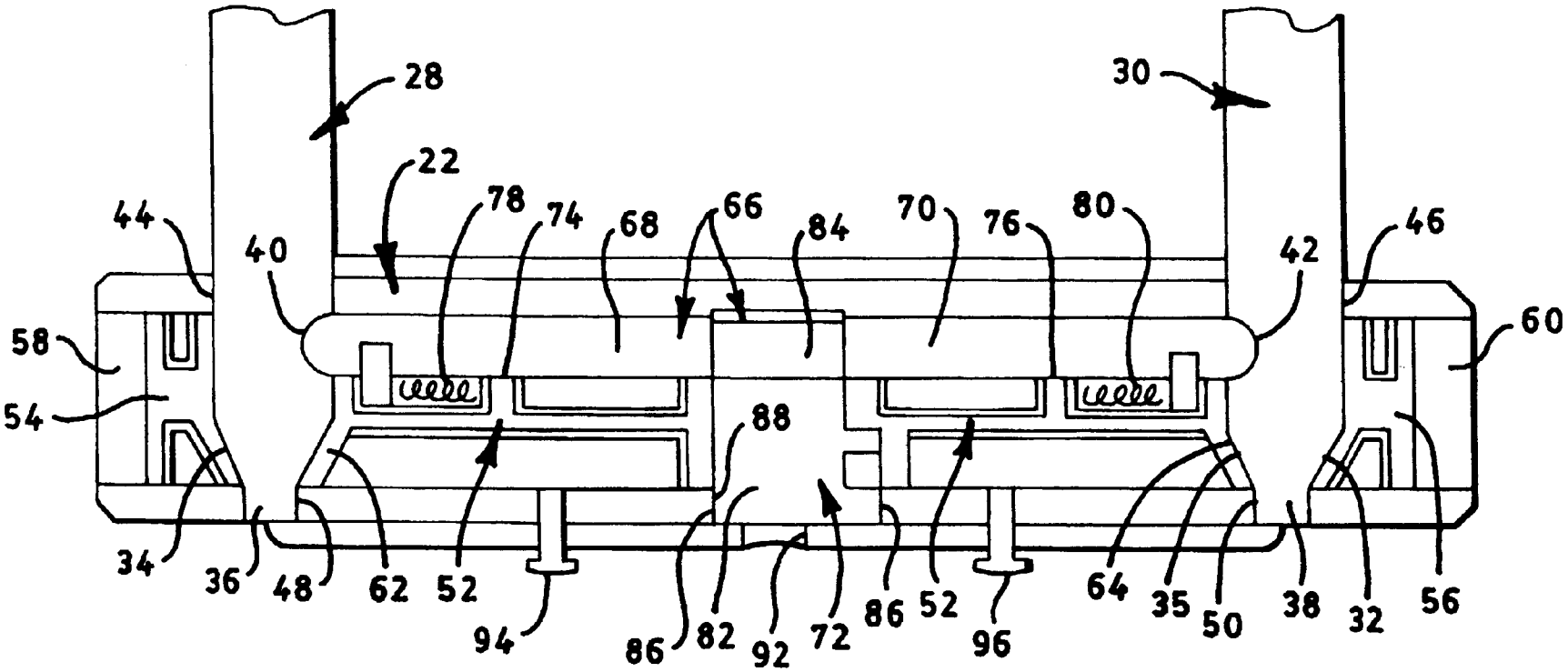
FIG. 4 is a broken-away cross-sectional view, showing the mechanism within the crossbar of the U-lock of FIGS. 1 through 3, taken along the lines 4—4 of FIG. 3.
Figure 6:
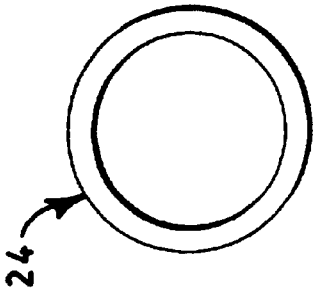
FIG. 6 is an end view of the sleeve as shown in FIG. 5.
Figure 8:
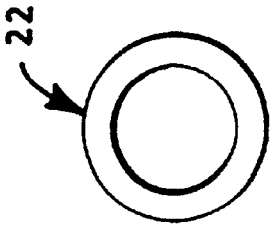
FIG. 8 is an end view of the crossbar as shown in FIG. 7.
Figure 5:
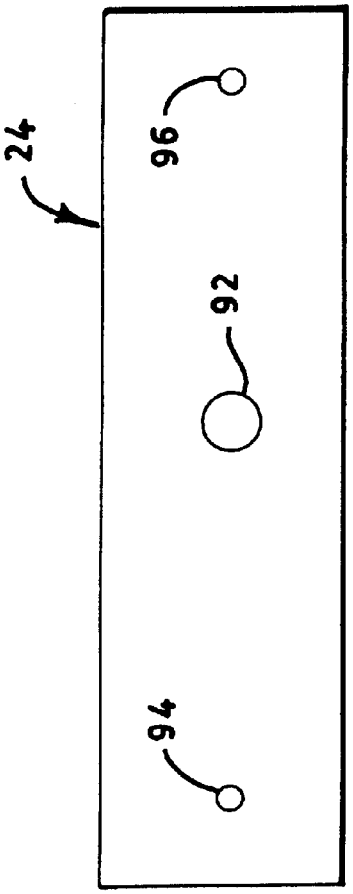
FIG. 5 is a bottom plan view of the sleeve of the U-lock assemblage of FIG. 1.
Figure 7:
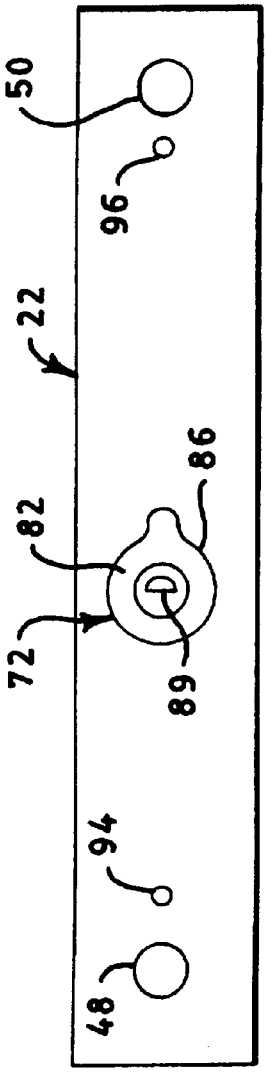
FIG. 7 is a bottom plan view of the crossbar of the U-lock assemblage of FIG. 1.
Figure 9A:
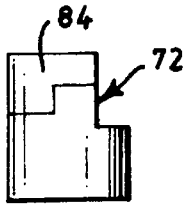
FIG. 9(*a*) is a side elevation of the lock of the U-lock assemblage of FIG. 1, shown in unlocked condition.

As shown in FIG. 4, within crossbar 22 is a web 52, which provides: end portions 54 and 56 for centering the web between two end plugs 58 and 60; and guide portions 62 and 64 for directing the projection portions of the legs into engagement with the pilot holes. Web 52 also provides for positioning parts of the lock mechanism and assists in their operation in a manner now to be described.

The lock mechanism, generally shown at 66, includes a pair of dead bolts 68 and 70, and a lock housing or barrel that is generally shown at 72. Dead bolts 68 and 70 are constrained by channels 74 and 76, which are established by the web and,are biased in opposite directions by a pair of springs 78 and 80. Lock housing or barrel 72 includes a stationary base 82 and a rotational head 84. Normally, the base and the head of the barrel are aligned for easy insertion and removal through a configured opening 86 in the crossbar into an analogously configured seat portion 88 in web 52. When so seated, lock head 84 may be rotated by a key that has been inserted into a keyway 89 in lock base 82.

Figure 10A:
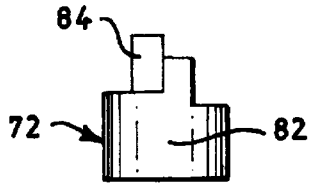
FIG. 10(*a*) is a side elevation of the lock of the U-lock assemblage of FIG. 1, shown in locked condition.
Figure 9B:
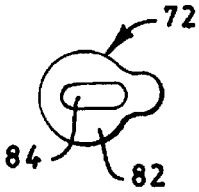
Figure 10B:
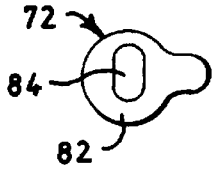
Figure 11:
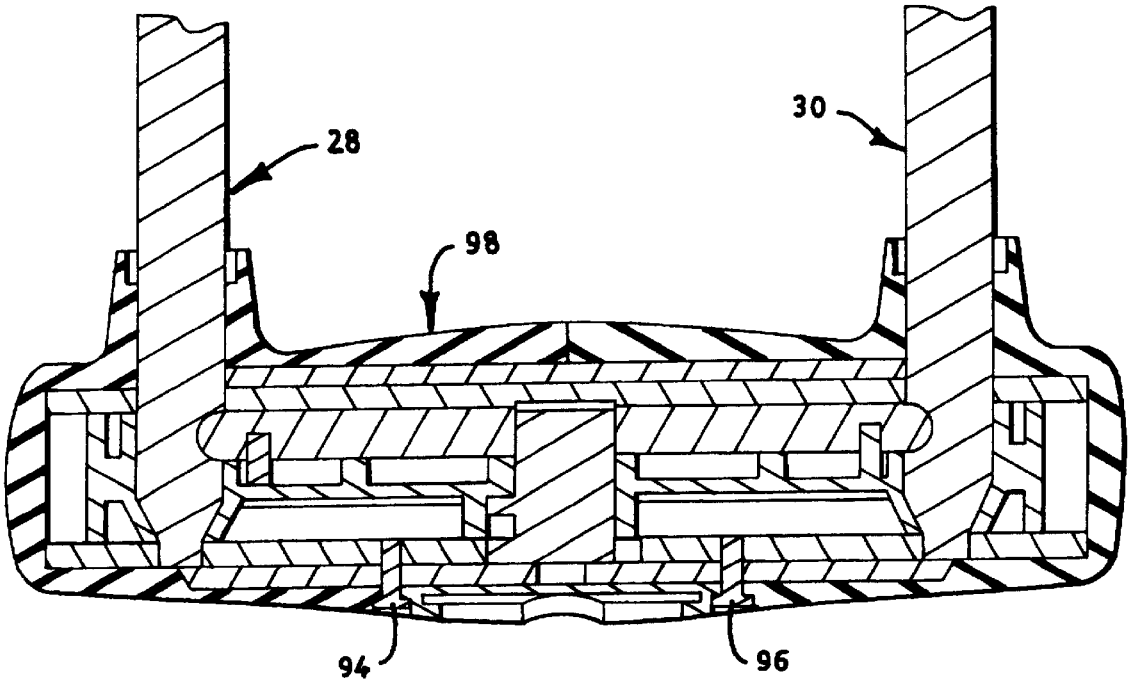
FIG. 11 is a cross-sectional view, corresponding to the view shown in FIG. 4, in which the crossbar is enclosed by an aesthetic yet functional plastic casement.

The arrangement is such that, when the lock mechanism is opened as shown in FIGS. 10(*a*) and 10(*b*), lock head 84 is oriented so that the dead-bolts are free to reciprocate under their spring bias to accommodate insertion and removal of the shackle feet through retainer holes 44 and 46 in the crossbar. But, when the feet of the shackle are fully seated in crossbar 22 and the lock mechanism is closed, lock head 84 forces the ends of dead bolts 68 and 70 into firm engagement with notches 40 and 42, thereby securing the shackle and the crossbar together.

Ordinarily, removal of lock housing 72 from the crossbar is prevented by sleeve 24. Sleeve 24 is provided with an aperture 92, which is aligned with the keyway in barrel base 82. This aperture is sufficiently small to enable retention of the lock within its seat and sufficiently large to permit access by a key to the keyway of the lock. The lock, once selected and inserted into the crossbar, is securely retained within the crossbar by the sleeve. The sleeve is joined to the crossbar by screws 94 and 96, which project through openings in the sleeve and are turned into threaded bores in the crossbar.

In practice, the shackle is provided with a plastic jacket 98. With the exception of the plastic jacket enveloping the crossbar and associated sleeve, and the plastic sleeve enveloping the shackle except for the feet, all components of the U-lock are composed of hardened steel.

Figure 12:
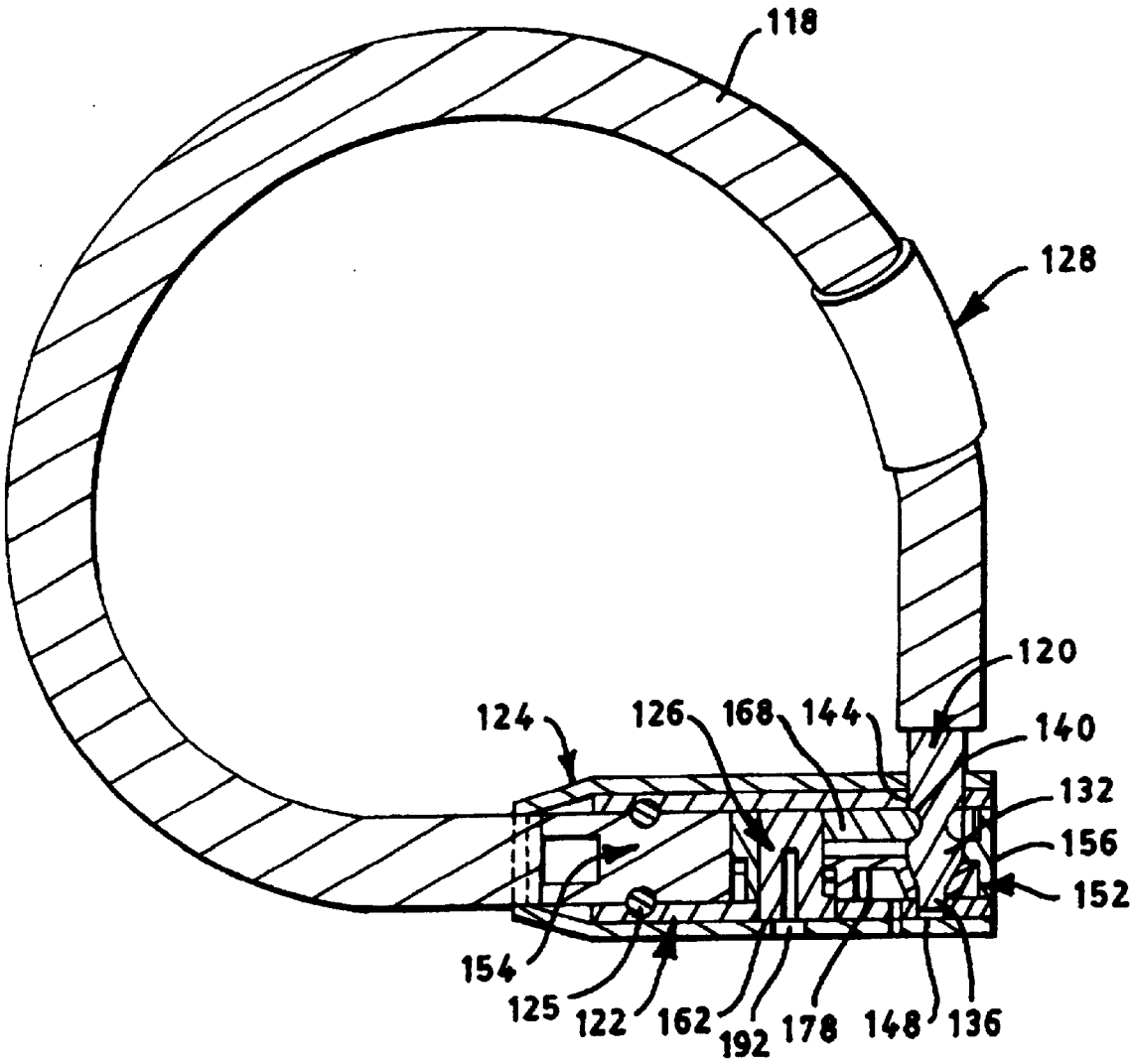
FIG. 12 is a cross-sectional view of a cable assemblage comprising a cable, a foot, an end bar and a sleeve, embodying the present invention.

The Cable Lock of FIG. 12

Another illustrated embodiment of the present invention is shown in FIG. 12 as comprising a cable 118, a foot 120, an end bar 122, a sleeve 124 and a locking assembly 126 within the crossbar.

As shown, foot 120 is securely connected to cable 118 by clamping, welding, swaging or the like. Typically, a plastic sleeve 128 is slipped over the entire length of cable 118. Foot 120 has a tapered portion 132, which extends to an axial projection portion 136 that has a reduced diameter. In proximity with this extremity is an inwardly directed notch 140.

As shown, end bar 122 is a hollow tube having a retainer hole 144 of relatively large diameter, and a pilot hole 148 of relatively small diameter. Retainer hole 144 and pilot hole 148 are aligned along a radial axis that is normal to the axis of the end bar. The arrangement is such that pilot hole 148 is adapted to receive projection 136 when leg 128 has been inserted through retainer hole 144.

Within end bar 122 are an outer web 152 and an inner plug 154. Web 152 provides an end portion 156 for capping the outer extremity of the end bar, and guide portions 162 for directing the projection portion of the leg into engagement with the pilot hole. Plug 154 is provided by an end of cable 118. Web 152, the inner end of which is contiguous with plug 154, also provides for positioning parts of the lock mechanism and assists in their operation in a manner now to be described.

The lock mechanism is identical to lock mechanism 66 of the embodiment of FIGS. 1 to 11. The lock mechanism includes a dead bolt 168 and a lock housing 172. Dead bolt 168 is constrained for axial movement along end bar 122 by web 152 and is biased outwardly by a spring 178. This lock mechanism is identical to the lock mechanism of the embodiment of FIGS. 1 to 11, including a stationary base, like that shown at 82, and a rotational head, like that shown at 84. Normally, the base and the head of the lock mechanism are aligned for easy insertion and removal through a configured opening in the crossbar into an analogously configured seat portion in web 152. When so seated, the lock head may be rotated by a key that has been inserted into a keyway in the lock base.

Sleeve 124 is shown as having a body portion 174 that fits over end bar 122, and as having an inner portion 176 that tapers toward cable portion 118. When foot 120 is. disengaged, the sleeve may be slid rearwardly over the cable to expose the lock mechanism. The end bar is secured to the plug by an insert 125.

The arrangement is such that, when the lock mechanism is opened, the lock head is oriented so that the dead bolt is free to reciprocate under its spring bias to accommodate insertion and removal of the foot through the retainer holes in the sleeve and the crossbar. But, when the feet of the shackle are fully seated in the crossbar and the lock mechanism is closed, the lock head forces the end of the dead bolt into firm engagement with notch 140, thereby securing the cable and the end bar together. Ordinarily, removal of the lock housing from the end bar is prevented by the sleeve. The sleeve is provided with an aperture 192, which is aligned with the keyway in the lock base. This aperture is sufficiently small to enable retention of the lock within its seat and sufficiently large to permit access by a key to the keyway of the lock. The lock, once selected and inserted into the crossbar, is securely retained within the crossbar by the sleeve. With the exception of the plastic jacket enveloping the cable, all components of the U-lock are composed of hardened steel.

OPERATION

Figure 13:
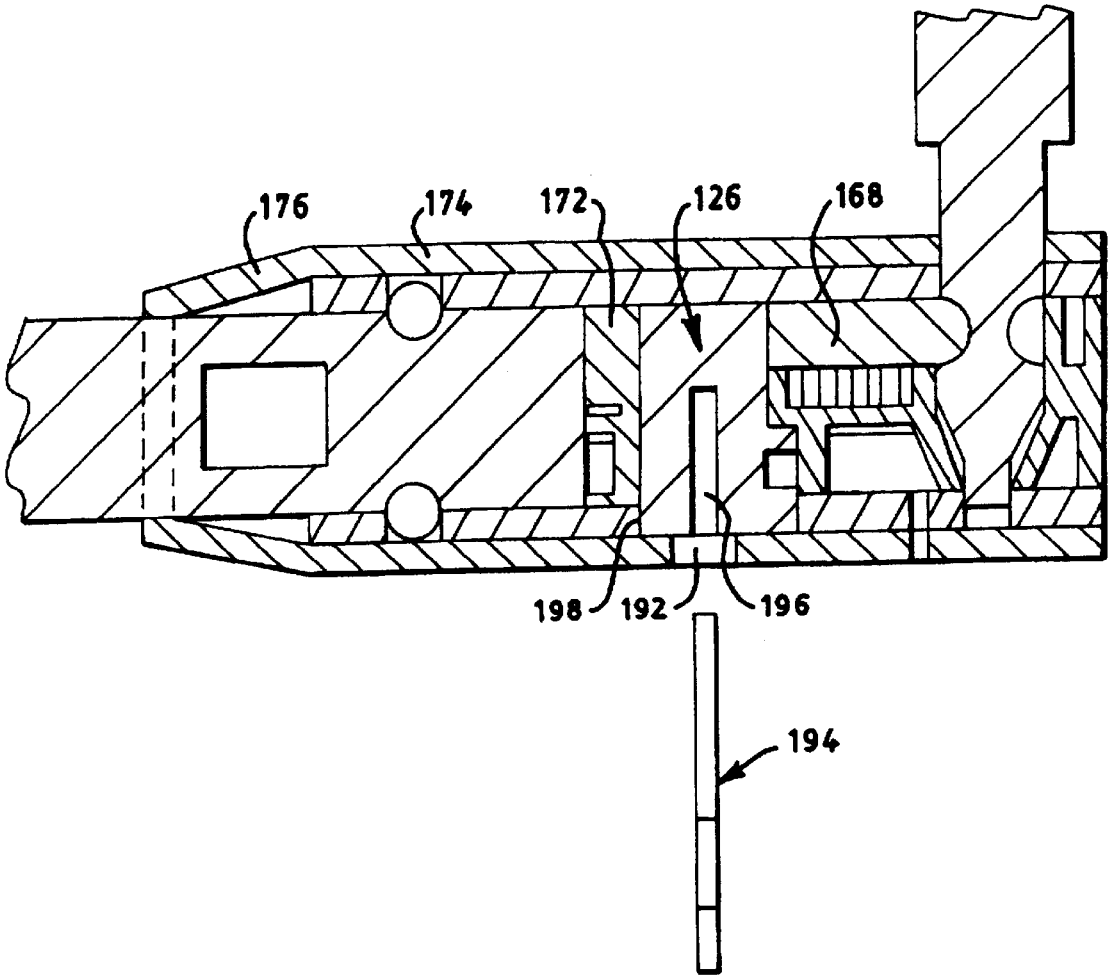
FIG. 13 is a blow-up showing the relationship between the cable assemblage of FIG. 12 and a side view of an associated key.
Figure 14:
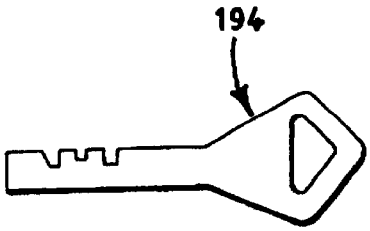
FIG. 14 is a plane view of the key of FIG. 13.

With particular reference to FIGS. 13 and 14, the present invention permits changing the locking mechanism in a tie lock assemblage, for example, a U-lock or cable lock, as often as desired, without compromising the resistance of the assemblage to physical damage. The locking mechanism

126, when operational, is protected by an auxiliary sleeve 124 that fits over the crossbar or end bar of the lock assemblage and that provides an aperture 192 that is too small to permit the locking mechanism to be picked or pried, but that is operatively positioned and large enough to provide access for a key 194 to the keyway 196 of the locking mechanism. The arrangement is such that, when (1) the shackle or cable, and (2) the sleeve are disengaged from the crossbar or end bar, the locking mechanism may be replaced readily through the opening in the crossbar or end bar.

What is claimed is:

1. A U-lock comprising:

(a) a shackle having two legs that are provide with configured feet;

(b) a straight crossbar having openings for receiving said feet, said crossbar having an axis and said openings having axes, said axes of said openings being substantially orthogonal with respect to said axis of said crossbar;

(c) at least a spring pressed deadbolt within said crossbar for mating with at least one of said configured feet, said deadbolt being reciprocable along said axis of said crossbar;

(d) a lock mechanism having a barrel providing a keyway and being located in a seat in said crossbar for controlling said deadbolt, said crossbar having an opening for providing access to said barrel, said last mentioned opening and said barrel lying along an axis that is substantially orthogonal to said axis of said crossbar; and (e) a sleeve about said crossbar with an aperture that is sufficiently small to enable retention of said barrel within said seat and sufficiently large to permit access by a key to said keyway; and (f) at least a screw attaching said sleeve to said crossbar when operative, and detaching said sleeve from said crossbar when inoperative, said screw when operative projecting through a hole in said sleeve and turned into a threaded bore in said crossbar, and when inoperative removed from said hole in said sleeve and turned out of said threaded bore in said crossbar;

(g) said sleeve being slideable paraxially along said crossbar when said screw is inoperative and said shackle is disengaged from said crossbar, between a secured position at which said aperture is aligned with said barrel and an unsecured position at which said sleeve is removed from said barrel, said barrel being removable from said seat when said sleeve is in said unsecured position.

2. A cable lock comprising:

(a) a cable and an end bar, said end bar being attached to one end of said cable, a leg attached to the other end of said cable, said leg having a configured foot;

(b) said end bar having a receiver opening for receiving said foot, said end bar having an axis and said receiver opening having an axis, said axis of said end bar and said axis of said receiver opening being substantially orthogonal;

(c) a spring pressed deadbolt within said end bar for mating with said configured foot, said deadbolt being reciprocable along said axis of said end bar;

(d) a lock mechanism providing a keyway and being located in a seat in said end bar for controlling said deadbolt, said end bar having an opening for providing access to said keyway, said opening and said keyway lying along an axis that is substantially orthogonal to said axis of said end bar; and (e) a sleeve about said end bar with an aperture that is sufficiently small to enable retention of said lock mechanism within said seat and sufficiently large to permit access by a key to said keyway;

(f) said sleeve having a rearward opening that encompasses said cable, said rearward opening being slideable paraxially along said cable and said sleeve being slideable paraxially along said end bar when said foot is disengaged from said end bar;

(g) whereby, when said foot and said sleeve are disengaged from said end bar, said lock mechanism within said seat may be replaced readily by another lock mechanism.

* * * * *